US005390789A

United States Patent [19]

Darby

[11] Patent Number: 5,390,789

[45] Date of Patent: Feb. 21, 1995

[54] PALLET SYSTEM FOR PACKAGING YARN SPOOL

[75] Inventor: Robert J. Darby, 2517-A Patriot Way, Greensboro, N.C. 27410

[73] Assignees: Robert J. Darby; Stephen S. Powel, Greensboro, N.C.

[21] Appl. No.: 127,299

[22] Filed: Sep. 27, 1993

[51] Int. Cl.[6] ..... B65D 85/672

[52] U.S. Cl. ..... 206/391; 206/497

[58] Field of Search ..... 206/391, 497, 600, 517

[56] References Cited

U.S. PATENT DOCUMENTS

| | | | |
|---|---|---|---|
| 4,482,051 | 11/1984 | Cantey, Jr. | 206/391 X |
| 4,516,677 | 5/1985 | Rowland et al. | 206/391 X |
| 4,580,680 | 4/1986 | Wind | 206/600 |
| 4,998,619 | 3/1991 | Sowa et al. | 206/497 X |

FOREIGN PATENT DOCUMENTS

| | | | |
|---|---|---|---|
| 465815 | 1/1992 | European Pat. Off. | 206/497 |

OTHER PUBLICATIONS

T.H.E.M. of Carolina, Inc.-brochure-Feb. 15, 1991.

*Primary Examiner*—David T. Fidei

*Attorney, Agent, or Firm*—Rhodes, Coats & Bennett

[57] ABSTRACT

A pallet system is used for shipping and storing packages of core wound material, such as yarn packages. The base pallet, top pallet, and separator grid all have integrally formed locator projections which engage the core of the yarn packages to prevent lateral shipping thereof. The locator projections which extend upwardly are configured differently, but complimentary to the projections which extend downwardly to allow nesting of the base pallet, separator grids, and top pallet for shipment back to the yarn supplier when the pallet is empty. The locator projections for engaging the top end of the yarn packages also have a continuous edge surface to insure proper seating of the projections within the yarn packages and to prevent contact between the projections and the yarn itself during placement of the top pallet or an upper separator grid onto a layer of yarn packages. When the multi-layer package is complete a wrap of shrink film secures the package and prevents shifting of the yarn packages during shipment and storage.

13 Claims, 10 Drawing Sheets

PALLET SYSTEM FOR PACKAGING YARN SPOOL

BACKGROUND OF THE INVENTION

The present invention is related to a pallet system for containerizing packages of goods, particularly core wound strand material. More particularly, the present invention is related to the provision of molded pallets, separator sheets, and the use of shrink film as a container, all which improve the overall palletizing operation.

The transportation and storage of yarn packages is accomplished by stacking the individual yarn packages on pallets which themselves can be stacked on one another. A typical pallet system includes a base pallet disposed below the lowermost layer in a stack of yarn packages, a top pallet disposed above the uppermost layer in the stack, and one or more separator grids disposed between the layers in the stack. Side panels made of corrugated board are then applied to the pallets to stabilize the pallets and to form a container for transporting and storing the yarn packages. The pallets and separator grids typically include a series of projections called locator nodes which engage the winding tubes of the yarn packages to locate the yarn packages on the pallet and to prevent the lateral shifting of the yarn packages during handling and transportation of the loaded pallets. These pallet systems have served adequately for many years. However, there remain a number of areas in which such pallet systems need improvement.

Some types of pallet systems used in the past are designed to be reusable. The pallets are made from a tough, molded plastic and are intended to nest with one another to form a compact package for shipment back to the yarn supplier. Nestable pallets and separator sheets that both nest properly and reliably engage and support the yarn packages has been a problem. The corrugated side panels are not reusable and are usually discarded. This results in unnecessary waste and increases the cost of shipping since new corrugated panels must be purchased.

Another problem with prior art pallet systems is that misalignment of the yarn packages on the pallet is either different or may result in damage to the yarn packages. A pallet typically holds 9–16 packages of yarn in each layer. When placing the top pallet or a separator grid over the yarn packages in the layer beneath, it is necessary to align the locator nodes of the top pallet with the opening in the winding tubes of the yarn packages. This is a cumbersome and difficult task and sometimes a yarn package will be tilted off center. If the locator node does not engage the winding tube of a yarn package properly, then damage can be caused to the transfer tail or to the yarn adjacent the end of the winding tube. Damage to the winding tube could also occur which would adversely effect the pay-out of the yarn from the package.

Another problem with prior art pallet systems is that the pallets or separator grids are not designed to adequately handle stress loads, particular stress caused by acceleration loads. Damage to the pallets or separator grids sometimes occurs due to excessive loads. Such damage could render the pallets or separator grids unusable.

SUMMARY AND OBJECTS OF THE INVENTION

The present invention is directed to a pallet system for shipping and storing packages of core-wound material, such as yarn packages. The pallet system includes a base pallet disposed below the lowermost layer in a stack of yarn packages, a top pallet disposed above the uppermost layer, and one or more separator grids disposed between layers of yarn packages. The base pallet, top pallet and separator grid all have integrally formed locator projections or protuberances which engage the core of the yarn packages to prevent lateral shifting thereof. The locator projections are designed to provide more accurate location of the yarn packages and to nest when the pallets are empty. To accomplish this, two different types of locator projections are used for engaging the bottom and the top of the yarn packages respectively.

The bottom projections include three relatively wide wedge-shaped node segments which are separated from one another by radial slots. The bottom nodes are used on the base pallet and on the top side of the separator grid and engage the yarn packages from below. The top projections include three planar members or fins which extend radially from a center point. The top edge of the fins is contiguous with the top edge of its companion fins to provide a continuous, uninterrupted edge surface. This continuous edge surface prevents misalignment of the yarn packages and facilitates proper entry of the fins into the yarn packages. If the yarn packages are not properly aligned with the top fins, the edge surface will engage the end of the winding tube and prevent the locator node from contacting the yarn. The top fins are used on the top pallet and on the bottom side of the separator grid.

The bottom nodes and top fins have complimentary configurations which allow nesting of the parts. That is, the fins of the top nodes align with the slots between the bottom nodes. When the pallets are empty, the pallets and separator grids can be stacked one on top of the other with the fins of the top nodes being received in the slots between the bottom nodes. Thus, a compact package can be formed for shipment back to the yarn supplier.

In another aspect of the present invention, a heat shrinkable, polyethylene film is used to stabilize the loaded pallets. The shrink film creates tension between opposite corners of each side. This serves to stabilize the pallet and prevent shifting or tilting of the packages in each layer. A heat shrinkable film is disposed around the loaded pallets and heated to form a tight skin around the loaded pallets The use of a heat shrinkable film eliminates the need for corrugated side panels thereby decreasing the cost of packaging and shipping the goods.

In yet another aspect of the present invention, the separator grid has been particularly designed to more evenly distribute stresses, particularly stresses caused by acceleration loads. The locator nodes of the separator grid are interconnected by main strengthening members. The largest stresses occur at the point of connection between the support members and the locator nodes. To handle the increased loads at this point, the cross-section of the support members are tapered from the center thereof towards the outer ends. That is, the width of the cross section is increased approximately 15–35% from the center of the support members to the outer ends thereof. Further, the shape of the support members, when viewed in cross section, has been designed to maximize stiffness while remaining easy to mold. Other objects and advantages of the present invention will become apparent and obvious from a study of the following description and the accompanying drawings which are merely illustrative of such invention.

DETAILED DESCRIPTION OF THE INVENTION

Figure 1:
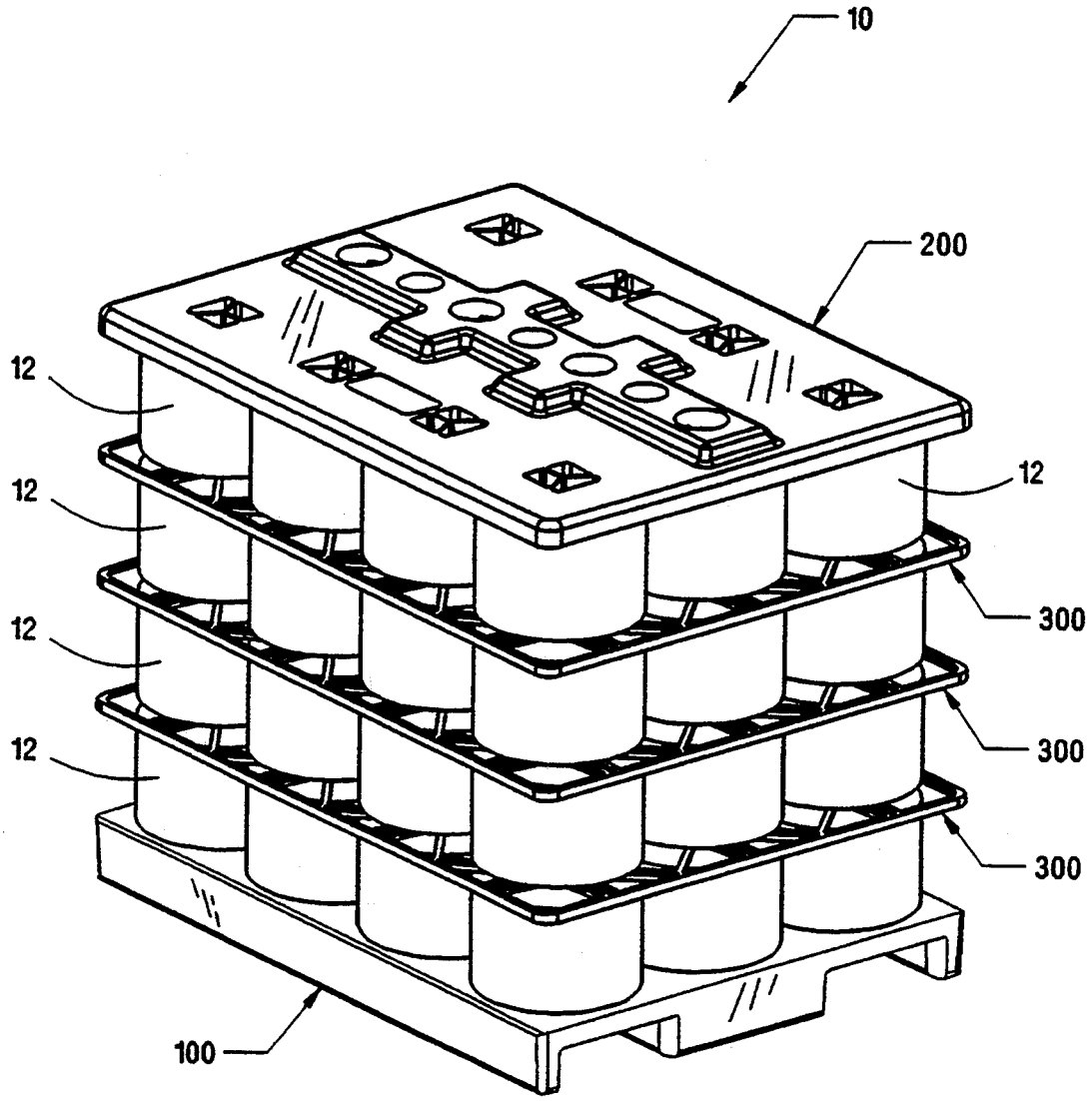
FIG. 1 is a perspective view of the pallet system of the present invention.

Referring now to the drawings, and particularly to FIG. 1, the pallet system 10 of the present invention is shown. The pallet system 10 is designed to contain packages of core-wound strand material, such as yarn packages 12. The pallet system 10 includes a base pallet 100, a top pallet 200, and one or more separator grids 300. The base pallet 100, top pallet 200, and separator grids 300 are all molded using a high density, polyethylene which provides strength and durability.

Figure 2:
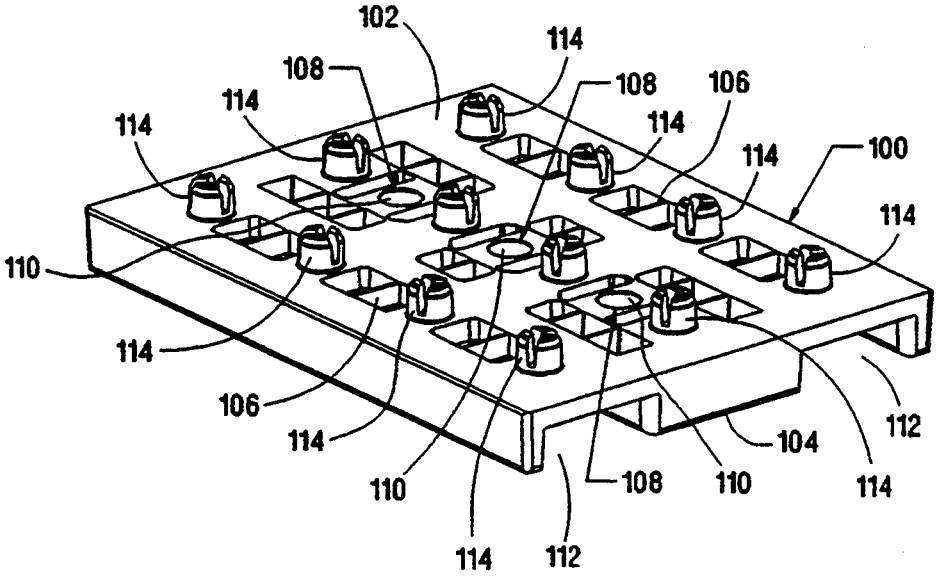
FIG. 2 is a perspective view of the base pallet as seen from the top.

The yarn packages 12 are stacked in multiple layers between the bottom pallet 100 and top pallet 200. The separator grids 300 are disposed between layers in the stack of yarn packages 12. Each layer in the stack typically includes 12 to 16 yarn packages arranged in columns and rows. Quite obviously, the pallet system 10 can also be designed to handle smaller or larger numbers of yarn packages 12. Referring now to FIG. 2, the base pallet 100 is shown. As illustrated in FIG. 2, the base pallet 100 has a planar, top surface 102 and a bottom surface 104 which are supported by a grid-like structure of integrally formed reinforcing members 106. This type of construction, referred to as waffle construction, is well known to those skilled in the art.

A series of apertures 108 defined by tubular walls 110 are formed in the base pallet 100 to provide means for handling the base pallet 100. Yarn packages 12 are generally handled by a mechanical gripping head (not shown) which is inserted into the winding tube and expanded to grip and transport the yarn package 12. The apertures 108 have an inner diameter equivalent to the inner diameter of the winding tube of the yarn packages 12. Thus, the same mechanical gripping device used for stacking and unstacking the yarn packages 12 can also be used for handling the base pallet 100. The gripping head, when activated, engages the tubular wall 110 in the same manner that it would engage the winding tube of a yarn package 12.

The base pallet 100 also includes two longitudinally extending channels 112 formed in the bottom surface 104 which are designed to receive the forks of a conventional forklift truck. Thus, the channels 112 provide a means for lifting and transporting the loaded pallets.

Figure 3:
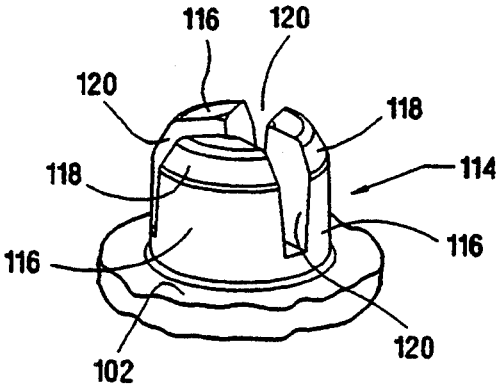
FIG. 3 is a perspective view of a top locator node.
Figure 4:
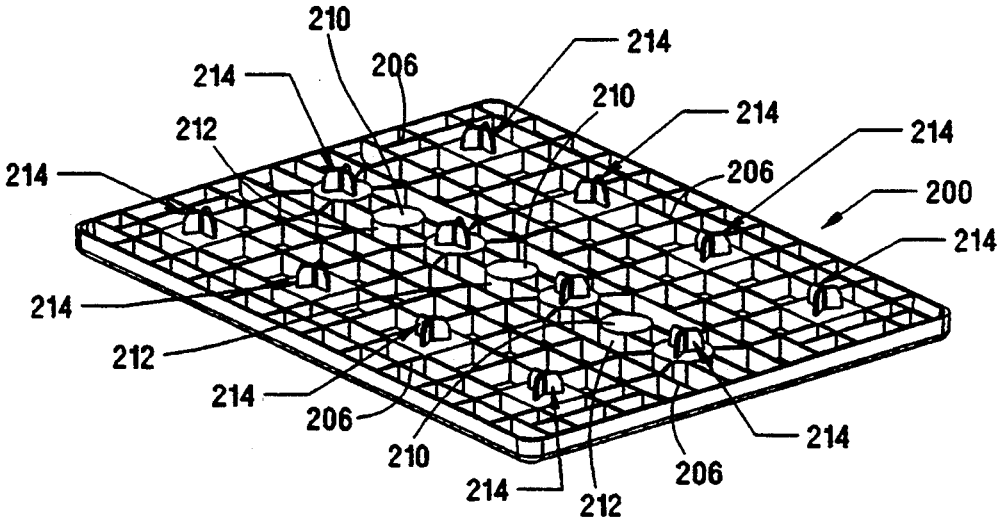
FIG. 4 is a perspective view of the top pallet as seen from the bottom.
Figure 5:
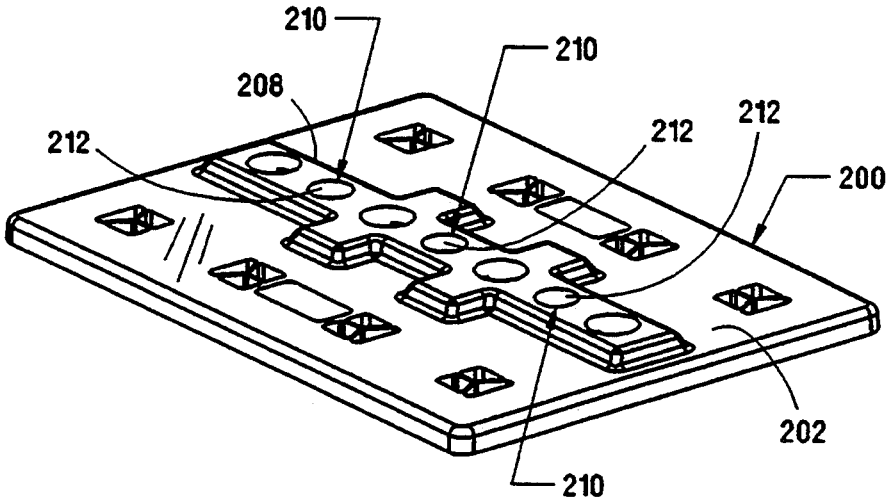
FIG. 5 is a perspective view of the top pallet as seen from the top.

Extending upwardly from the planar top surface 102 are twelve locator nodes 114 which are arranged in a 3×4 array. The locator nodes 114 engage the winding tubes of the yarn packages 12 to assist in locating the yarn packages 12 on the pallet and to prevent lateral shifting of the yarn packages 12 during handling. The locator nodes 114 are described in further detail below, As seen in FIG. 3, the nodes 114 have a generally cylindrical configuration and taper slightly from bottom to top. The locator nodes 114 comprise three relatively wide wedge shaped node segments 116 (approximately 100°). Each node segment 116 includes a chamfer 118 at the upper end thereof. The node segments 116 are separated by relatively narrow radially extending slots 120 which converge at a center point of the locator node 114. The function of the slots 120 will become apparent from a further description of the invention.

The top pallet 200 is shown in FIGS., 4–6. The top pallet 200 includes top and bottom surfaces 202 and 204 which are supported by a grid-like structure of reinforcing members 206. A raised section 208 is formed in the top surface 202. The raised section 208 fits into the recess in the base pallet 100 to provide a mechanical interlock when the loaded pallet systems 10 are stacked on top of one another.

A series of apertures 210 are formed in the raised section 208 which align with the apertures 108 in the base pallet 100. The apertures 210 are defined by tubular walls 212 which are adapted to be gripped by a mechanical gripping member as hereinabove described.

Figure 6:
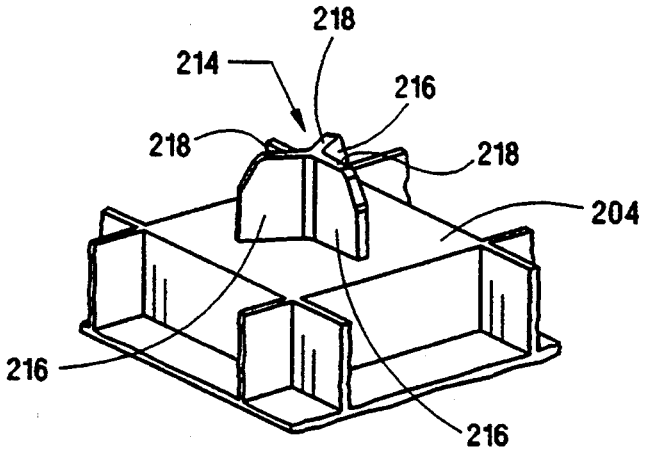
FIG. 6 is a top perspective view of a top projection forming a part of the present invention.
Figure 7:
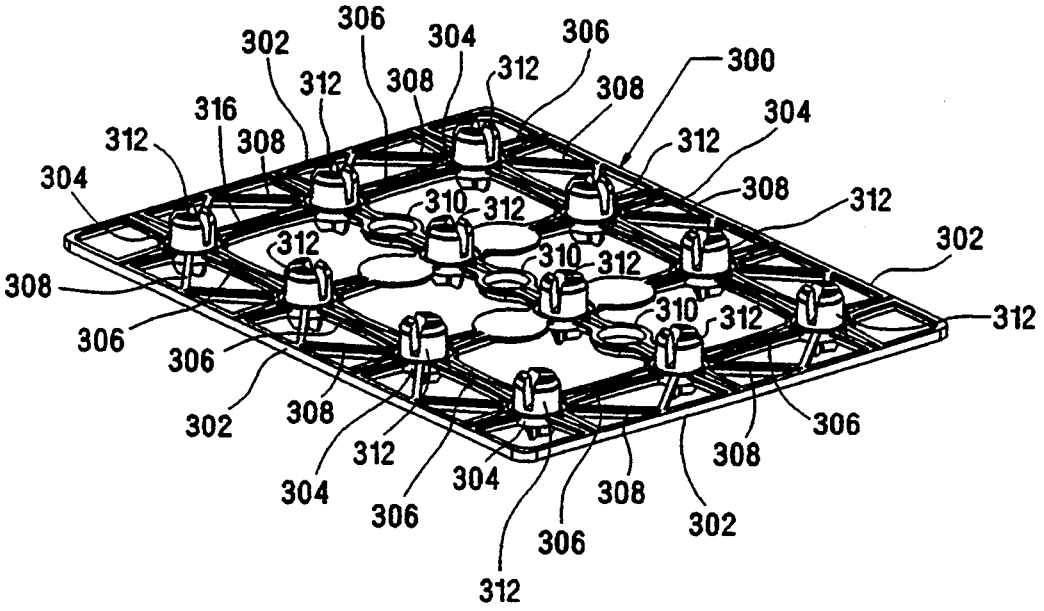
FIG. 7 is a perspective view of the separator grid as seen from the top.
Figure 8:
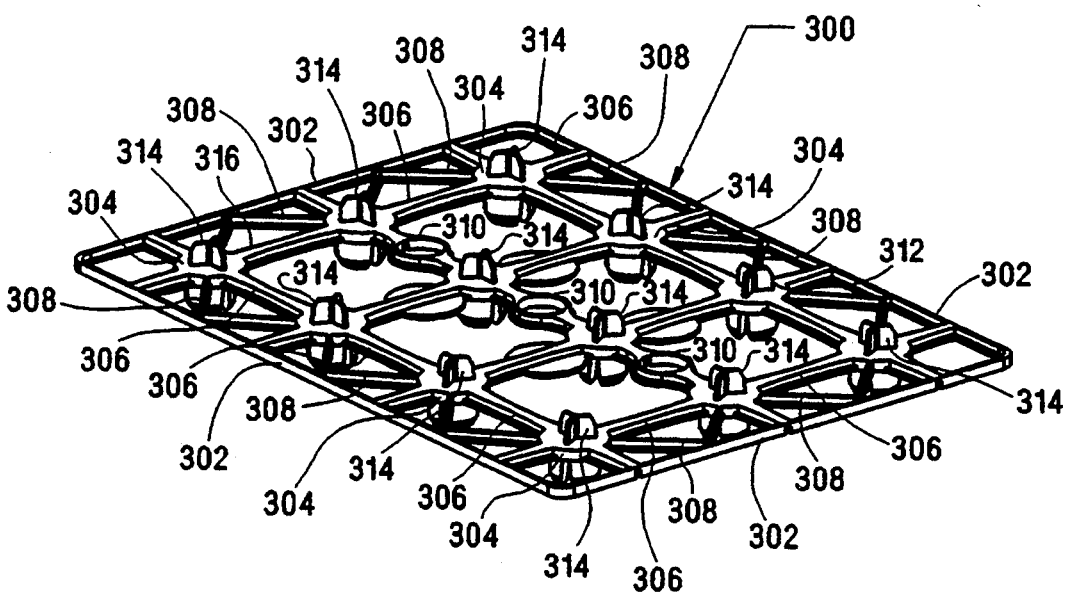
FIG. 8 is a perspective view of the separator grid as seen from the bottom.

A plurality of upper locator projections 214 depend downwardly from the bottom surface 204 of the top pallet 200. The locator projections 214, referred to as top projections, are designed to engage the winding tubes of the yarn packages 12 from the top and align with the bottom nodes 114 of the base pallet 100. As shown in FIG. 6, each top projection 214 includes three blade-like fins 216 which extend radially from a center point of the node 214. The fins 216 are disposed at a 120° angle with respect to one another. The fins 216 of the top node 214 include a top edge 218 which is contiguous with the top edges of the other fins 216. The contiguous edges 218 of the fins 216 serve to prevent damage to the yarn package when placing the top pallet 200 onto the uppermost layer of yarn packages 12. When placing the top pallet onto the uppermost layer of yarn packages, it is necessary to align the top projections 214 with the winding tubes of the yarn packages 12. If the yarn packages 12 are not properly aligned with the top nodes 214, the top edges 218 of the fins 216 will engage the end of the winding tube. Thus, the contiguous edges 218 prevent the top projection 214 from coming into contact with and damaging the yarn in the yarn packages 12.

It will be also noted that the configuration of the top projections 214 is complementary to the configuration of the bottom nodes 114. That is, the fins 216 of the top projections 214 align with the slots 118 in the bottom nodes 114. This allows nesting of the base pallet 100 and top pallet 200 to form a compact package for shipment back to the yarn supplier.

Referring now to FIGS. 7–10, the separator grid 300 is shown. The separator grid 300 has a generally rectangular outer frame 302 having a generally L-shaped cross-section. A plurality of support pads 304 are arranged in a 3×4 array within the outer frame 302. The support pads 304 are connected to the outer frame 302 and to one another by main strengthening members 306 which extend parallel to the sides of the outer frame 302. The axis of the main strengthening members 306 align with the center of the support pads 304. The support pads 304 are also connected to the outer frame 302 by reinforcing members 308 which extend at an angle relative to the sides of the outer frame 302 to form a series of triangles in a manner similar to a truss. The reinforcing members 308 provide strength and stiffness to the separator grid 300.

Figure 9:
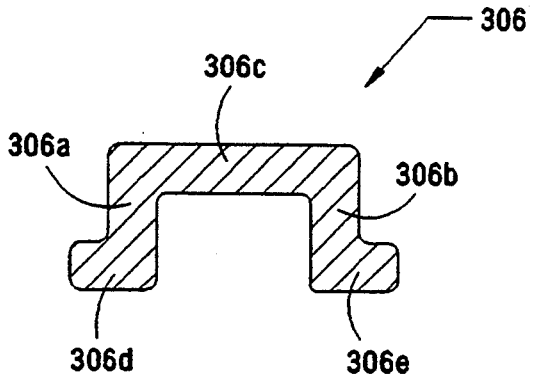
FIG. 9 is a cross-sectional view of the frame member in the separator grid taken through the center of the frame member.
Figure 10:
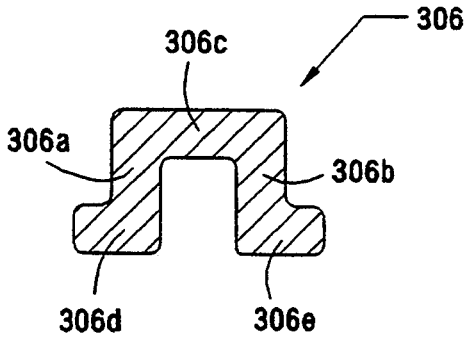
FIG. 10 is cross-sectional view of the frame member in the separator grid taken adjacent one end thereof.

The main strengthening members 306 have been optimized to handle bending forces acting on the separator grid 300. Each strengthening member 306, when viewed in cross section, resembles a hat (FIGS. 9 and 10). The strengthening members 306 include a pair of laterally spaced side members **306*a* and 306*b* which extend generally longitudinally between support pads 304. The side members 306*a* and 306*b* are interconnected by a top web 306*c* which forms the top of the hat. A pair of flanges 306*d* and 306*e* extend outwardly from the bottom edges of respective side members 306*a* and 306*b*. The flanges 306*d* and 306*e* form the brim of the hat. The "hat" section maximizes the stiffness of the strengthening members 306** while remaining easy to mold.

It will be also noted that the dimensions of the main strengthening member 306 vary from the center of the strengthening member 306 to the outer ends thereof. That is, the main strengthening members 306 increase in width approximately 15–35% from the center to the ends as seen in FIGS. 9 and 10. The purpose of the enlarged ends is to handle the increased stress at the point of connection between the strengthening members 306 and the support pads 304. The taper also provides uniform stressing of the support member 306 throughout its length which improves the efficiency of the support member 306 in carrying loads.

It will also be noted that certain main strengthening members 306 extending along a centerline of the separator grid 300 include integrally formed rings 310. The rings 310 in the separator grid 300 align with the apertures 108 in the base pallet 100 and the apertures 210 in the top pallet 200. The inner wall of the rings 310 provide a gripping surface for the gripping head in a manner similar to the tubular walls 210 and 212.

The separator grid 300 is designed to be inserted between layers in a stack of yarn packages 12. Thus, the separator grid 300 includes locator nodes 312 and 314 which extend respectively from the top and bottom of the support pads 304. The locator nodes 312 on the upper side of the support pads 304 are constructed in the same manner as the bottom nodes 114 on the base pallet 100. The locator nodes 314 depending downwardly from the support pads 304 are constructed in the same manner as the top nodes 214 on the top pallet 200. Thus, the separator grids can be nested with one another and with the base pallet 100 and top pallet 200 when returning the pallet system 10 to the yarn supplier.

In use, the base pallet 100 is placed on a conveyor or other surface where it is to loaded. The first layer of yarn packages 12 is placed on the base pallet so that the bottom nodes 114 engage the winding tube of the yarn packages 12. After the base pallet 100 is loaded, a separator grid 300 is placed on top of the first layer of yarn packages 12. When placing the separator grid 300, the top nodes 314 on the underside of the grid 300 are engaged in the winding tubes of the yarn packages. As previously described, if one of the yarn packages is tilted slightly off center, the fins 216 of the top node 314 will engage the end of the winding tube to prevent damage to the yarn package 12.

The yarn packages 12 are stacked in this manner until the desired number of layers has been obtained. A separator grid 300 is inserted between each layer. The top pallet 200 is then placed on top of the uppermost layer of yarn packages 12.

Figure 11:
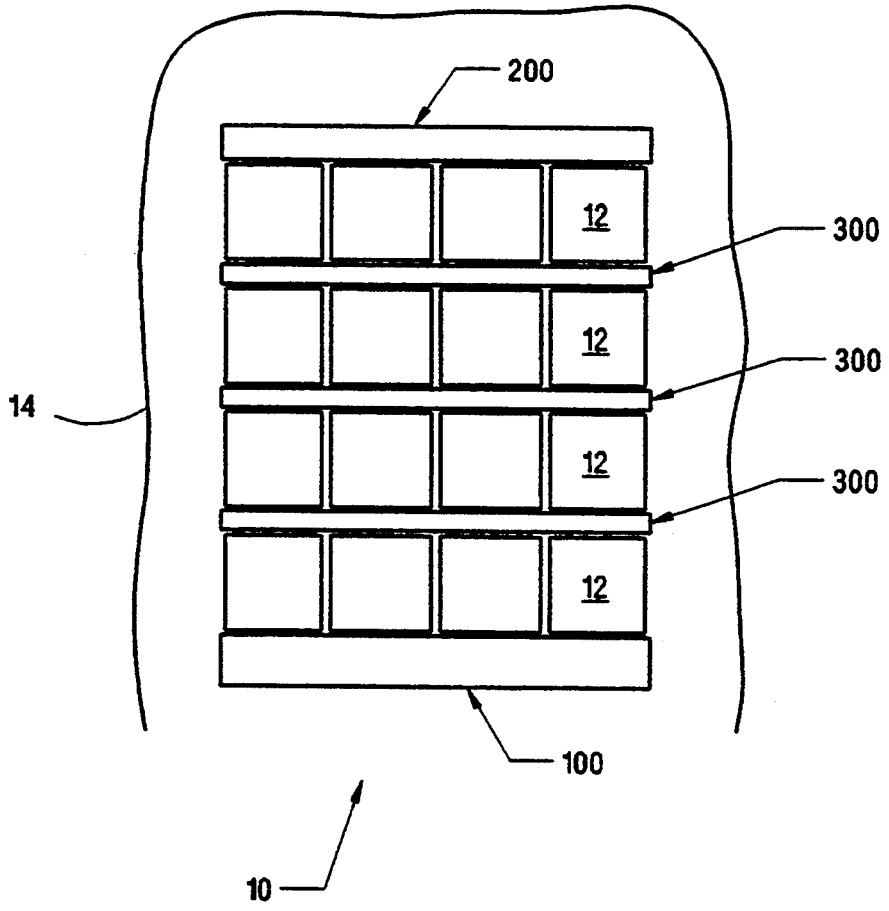
FIG. 11 is a diagram illustrating a loaded pallet system with a heat shrinkable film being applied.

To stabilize the loaded pallet assembly 10, the entire package is "shrink-wrapped", using a four to six mil polyethylene shrink film 14. FIG. 11 shows in diagrammatic form how the shrink film 14 is applied. The shrink film 14 is in the form of a bag which is pulled down over the top of the loaded pallet assembly 10. Heat is applied to shrink the polyethylene film 14 around the loaded pallet system 10 to form a tight skin that stabilizes the loaded pallet assembly 10 allowing it to be moved. The loaded pallet assembly 10 can thus be shipped to the end user and stored in this form until needed. The base pallet 100 and top pallet 200 are perfectly designed to interlock with one another to allow stacking of the pallet assemblies 10 on top of one another. Since interlocking pallets are well-known in the art, further description of this feature is omitted.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A yarn pallet system for palletizing multiple individual packages of strand material which is wound on a hollow cylindrical core, comprising:

(a) a base pallet disposed below said packages including:

(1) a generally planar support surface;

(2) a plurality of locator projections extending upwardly from the support surface for engaging the core of respective packages thereabove;

(3) wherein the first locator projection includes at least three generally wedge-shaped node segments separated by slots extending radially from a center point of said node between adjacent node segments;

(b) a top pallet disposed above said packages including:

(1) a downwardly facing support surface;

(2) a plurality of second locator projections extending downwardly from the support surface for engaging the core of respective packages therebelow; and (3) wherein the second locator projections each include at least three fins extending radially from a center point of said node and aligning with the slots between the node segments in the base to allow nesting of the top pallet with the base pallet at times when said packages have been removed and base and top pallets are stacked for return to the yarn manufacturer.

2. The yarn pallet system of claim 1 wherein the fins of the second locator projections each include an edge surface which is contiguous with the edge surfaces of the other fins.

3. The pallet system of claim 1 further including a separator grid for insertion between layers of said packages stacked between said top and bottom pallets.

4. The yarn pallet system of claim 3 wherein the separator grid includes an upper surface having a plurality of first locator projections for insertion into the core of respective packages in an upper layer in said stack, and a lower surface having a plurality of second locator projections depending downwardly therefrom for insertion into the core of respective packages in a lower layer in said stack, said first locator projections being formed substantially identically to the projections on said base pallet and said second locator projections being formed substantially identically to the projections on said top pallet.

5. A separator grid for insertion between layers of a stack of yarn packages assembled in a yarn pallet system which palletizes packages of strand material wound on a hollow cylindrical core comprising (a) a plurality of support pads arranged into an array and connected;

(b) a plurality of first locator projections extending upwardly from respective support pads for insertion into the core of respective packages in an upper layer of said stack, said first locator projections each including at least three generally wedge-shaped node segments separated by slots extending radially from a center point of said first projection between adjacent node segments;

(c) a plurality of second locator projections extending downwardly from respective support pads for insertion into the core of respective packages in a lower layer of said stack, said second locator projections each including at least three fins extending radially from a center point of said second projection;

(d) said fins aligning with the slots between said wedge-shaped node segments on the opposite side of said separator sheet;

(e) whereby said fins will nest between corresponding node segments at times when said yarn packages have been unloaded and said separator sheets are stacked for return to the yarn manufacturer and whereby said nodes segments may be made larger.

6. The separator grid according to claim 5, wherein said node segments subtend an arc of greater than 60°.

7. The separator grid according to claim 6 wherein said arc is approximately 100°.

8. In a yarn pallet system for palletizing multiple individual packages of strand material which is wound on a hollow cylindrical core, a separator grid for insertion between layers in a stack of packages comprising:

(a) a plurality of support pads arranged into an array;

(b) a plurality of first projections extending upwardly from respective support pads for insertion into the core of respective packages in an upper layer of said stack;

(c) a plurality of second projections extending downwardly from respective support pads for insertion into the core of respective packages in a lower layer of said stack; and (d) a plurality of strengthening members extending between and interconnecting at least some of said adjacent support pads in said array, wherein the strengthening members have a tapered cross-section which increases in width from the center of the support member to the outer ends thereof.

9. The separator grid of claim 8 wherein the cross-section of said strengthening members increase in width approximately 15–35% from the center to the outer ends thereof.

10. The separator grid of claim 8 wherein each strengthening member includes two laterally spaced side members having a top edge and a bottom edge, a top web joining the top edges of the side members, a pair of flanges extending outwardly from the bottom edges of respective side members.

11. In a yarn pallet system for palletizing multiple individual packages of strand material which is wound on a hollow cylindrical core, a separator grid for insertion between layers in a stack of packages comprising:

(a) a plurality of support pads arranged into an array;

(b) a plurality of first projections extending upwardly from respective support pads for insertion into the core of respective packages in an upper layer of said stack;

(c) a plurality of second projections extending downwardly from respective support pads for insertion into the core of respective packages in a lower layer of said stack;

(d) a plurality of strengthening members extending between and interconnecting at least some of said adjacent support pads in said array; and (e) wherein the support members include a pair of laterally spaced side members having top and bottom edges, a web member extending between and interconnecting the top edges of the side members, and a pair of flanges extending outwardly from the bottom edges of respective side members.

12. The separator grid of claim 11 wherein the support members have a tapered cross-section which increases in width from the center of the support member to the outer ends thereof.

13. The separator grid of claim 12 wherein the width of the support member at the outer ends is 15–35% greater than the width of the support member at the center.

* * * * *